US007190887B1

(12) United States Patent
Compton

(10) Patent No.: US 7,190,887 B1
(45) Date of Patent: Mar. 13, 2007

(54) PORTABLE THERMAL-STRATIFYING SPACE HEATER AND POWERPLANT PACKAGE

(76) Inventor: Stephan S. Compton, 501 Piney Oak Dr., Norman, OK (US) 73072

( * ) Notice: Subject to any disclaimer, the term of this patent is extended or adjusted under 35 U.S.C. 154(b) by 0 days.

(21) Appl. No.: 11/094,941

(22) Filed: Mar. 28, 2005

(51) Int. Cl.
*F24D 15/02* (2006.01)

(52) U.S. Cl. ..... 392/365; 219/533

(58) Field of Classification Search ..... 392/360–369, 392/383, 373–374; 219/533; 454/190
See application file for complete search history.

(56) References Cited

U.S. PATENT DOCUMENTS 1,534,571 A * 4/1925 Conning ..... 392/367
1,644,595 A * 10/1927 Karg ..... 126/67
2,025,216 A 12/1935 Opitz
2,091,838 A 8/1937 Staak
2,109,279 A 2/1938 Soverhill
2,151,140 A 3/1939 Novak
2,276,093 A * 3/1942 Robbins ..... 126/101
2,480,809 A 8/1949 Freyman
2,481,077 A * 9/1949 Buell ..... 392/370
2,683,796 A * 7/1954 Koff ..... 392/356
2,706,241 A * 4/1955 Granger, Jr. ..... 392/365
2,712,053 A * 6/1955 Gallay ..... 392/367
2,839,657 A 6/1958 Mast
2,987,259 A 6/1961 Lindquist
3,176,117 A 3/1965 Knoll et al.
3,305,164 A * 2/1967 Laing ..... 417/350
3,362,469 A * 1/1968 Berner et al. ..... 165/122
3,575,582 A * 4/1971 Covault ..... 392/356
3,681,567 A 8/1972 Boecher
3,880,140 A * 4/1975 Scogin ..... 126/110 R
3,924,099 A * 12/1975 Housel ..... 392/368
3,973,101 A * 8/1976 Bosse ..... 392/369
4,053,732 A 10/1977 Carter
4,642,441 A 2/1987 Kenyon
4,737,616 A * 4/1988 Wen-Ying ..... 392/365
4,947,025 A 8/1990 Alston et al.
5,278,936 A * 1/1994 Shao ..... 392/365
5,467,423 A * 11/1995 Jakubowski ..... 392/379
5,655,055 A * 8/1997 Goldstein et al. ..... 392/367
5,805,767 A 9/1998 Jouas et al.
5,867,926 A * 2/1999 Schmitt ..... 37/227

(Continued)

FOREIGN PATENT DOCUMENTS

CA 474108 * 6/1951 ..... 392/360

(Continued)

*Primary Examiner*—Thor Campbell
(74) *Attorney, Agent, or Firm*—Mitchell K. McCarthy

(57) ABSTRACT

A portable room heater is provided comprising an upright enclosure defining an inlet at a lower end of the enclosure, an outlet at an upper end of the enclosure, and a passageway fluidly connecting the inlet and the outlet. The portable room heater further comprises a blower imparting an airflow through the passageway, and thereby creating an inlet airflow through the inlet and a noncoplanar outlet airflow through the outlet. A heat generating member in the passageway selectively heats air flowing through the passageway. A method is provided for warming a room comprising providing the portable electric heater, drawing air from a relatively lower horizontal plane of the room into the heater, heating the drawn air, and releasing the heated air in a substantially horizontal direction in a relatively higher horizontal plane of the room.

15 Claims, 5 Drawing Sheets

U.S. PATENT DOCUMENTS

| | | | | |
|---|---|---|---|---|
| 6,167,193 | A | 12/2000 | Birdsell et al. | |
| 6,280,211 | B1 * | 8/2001 | Tateishi | 439/131 |
| 6,386,968 | B2 * | 5/2002 | Mehlman et al. | 454/190 |
| 6,480,672 | B1 * | 11/2002 | Rosenzweig et al. | 392/365 |
| 6,760,543 | B1 * | 7/2004 | Orr et al. | 392/365 |

FOREIGN PATENT DOCUMENTS

| | | | | |
|---|---|---|---|---|
| DE | 2255305 | * | 5/1974 | |
| DE | 2363006 | * | 7/1974 | 392/367 |
| DE | 3200217 | * | 7/1983 | |
| FR | 929954 | * | 1/1948 | 392/367 |
| FR | 2673270 | * | 8/1992 | |
| JP | 59-161616 | * | 9/1984 | 392/365 |
| JP | 64-58957 | * | 3/1989 | 392/360 |
| JP | 11-83118 | * | 3/1999 | |

* cited by examiner

PORTABLE THERMAL-STRATIFYING SPACE HEATER AND POWERPLANT PACKAGE

FIELD OF THE INVENTION

The embodiments of the present invention relate generally to the field of utility tools and more particularly without limitation to a portable electric heater for working with powered equipment in a conditioned air space.

BACKGROUND OF THE INVENTION

Portable heating units are used extensively to condition the air space, either indoor or outdoor, to provide more productive working conditions. In the construction industry, for example, subcontractors will typically perform higher quality work in a timelier manner if provided a heated work space during cold weather.

There are, however, good reasons to deny workers the use of a building's heating system during construction. This is because there are a good number of chemicals, such as paints, varnishes, and adhesives that will attack the materials in the heating venting and air conditioning (HVAC) equipment, creating premature corrosion and/or other modes of failure.

Portable combustion heaters are one solution. However, combustion by-products are unpleasant to breathe, and typically require some venting of the work space which, in cold weather, makes for continual cold air drafts preventing a room from ultimately achieving a steady comfortable temperature. The combustion by-products can also adversely affect some chemicals used in construction such as stains and varnishes.

Electric space heaters are used is some instances, which resolves the combustion by-products problem. However, known electrical heaters are either very limited in the volume of air that can be comfortably heated, or are very obtrusive in the extent to which they create windage disturbances, generally creating continual hot and cold spots in the room. Basically, as pertaining to room comfort, an electric fan with a heater coil pushes around a good amount of cold air, making for a drafty solution.

What is needed is an electric total room conditioning solution, one that optimally heats the room air to bring it to a steady and comfortable temperature and without cold air drafts. What is also needed is a heater that provides an electrical supply source for powering equipment at the same time as the heater is powered by a common electrical drop. It is to these improvements and others as exemplified by the description and appended claims that embodiments of the present invention are directed.

SUMMARY OF THE INVENTION

In accordance with preferred embodiments, an apparatus is provided for a portable heater and powerplant package.

In some embodiments a portable room heater is provided comprising an upright enclosure defining an inlet at a lower end of the enclosure, an outlet at an upper end of the enclosure, and a passageway fluidly connecting the inlet and the outlet. The portable room heater further comprises a blower imparting an airflow through the passageway, and thereby creating an inlet airflow through the inlet and a noncoplanar outlet airflow through the outlet. A heat generating member in the passageway selectively heats air flowing through the passageway.

A method is provided for warming a room comprising providing the portable electric heater, drawing air from a relatively lower horizontal plane of the room into the heater, heating the drawn air, and releasing the heated air in a substantially horizontal direction in a relatively higher horizontal plane of the room.

A portable environmental conditioning apparatus is provided comprising a heat source, and means for warming a room by preserving stratified zones of relatively warmer and relatively cooler air, and heating air from the cooler air zone.

These and various other features and advantages which characterize the claimed invention will become apparent upon reading the following detailed description and upon reviewing the associated drawings.

DETAILED DESCRIPTION

Figure 2:
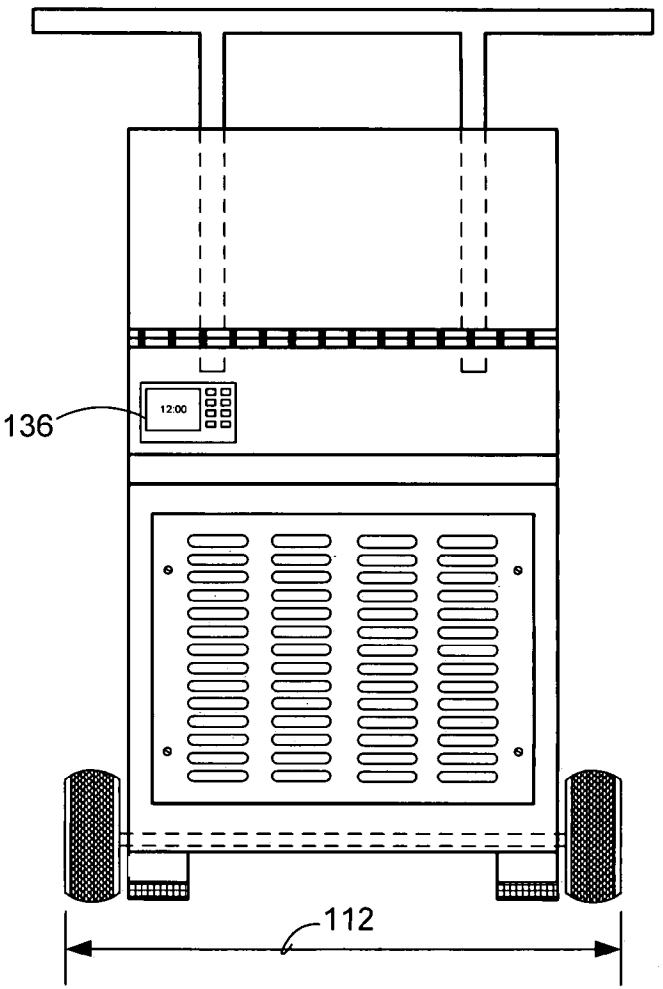
FIG. 2 is a front elevational view of the apparatus of FIG. 1.
Figure 1:
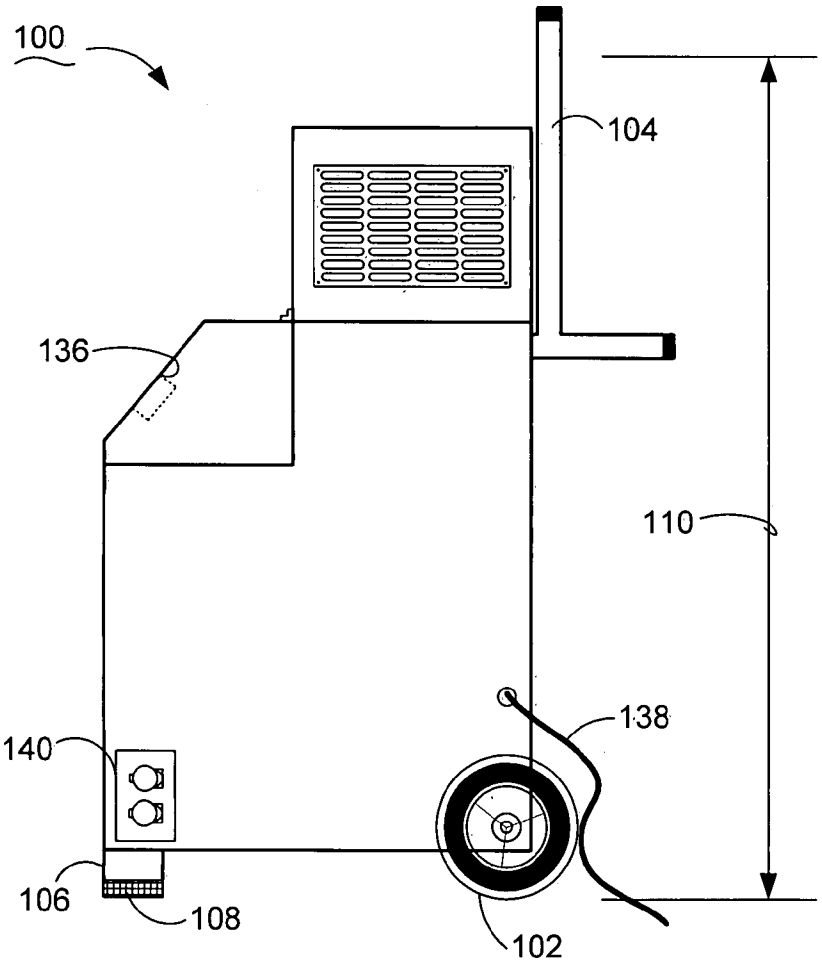
FIG. 1 is a side elevational view of a portable heater and powerplant package apparatus constructed in accordance with embodiments of the present invention.

FIGS. 1 and 2 are side and front elevational views, respectively, of a portable heater and powerplant package apparatus ("heater package") 100 that is constructed in accordance with embodiments of the present invention. The heater package 100 generally has an upright enclosure that is preferably transportable upon a pair of opposing wheels 102. A handle 104 is attached to the enclosure to enable a user to pivot it around the wheels 102 and thereby transport the heater package 100 in a manner like a two-wheeled cart. One or more pads 106 are provided preferably with a vibration damping material 108, such as an elastomeric material, for supporting the enclosure opposite the wheels 102. It will be noted that the height 110 and width 112 can be constructed such that the heater package 100 can be readily transported into a residential-sized doorway without disassembly of either the heater package 100 or the doorway.

Figure 3:
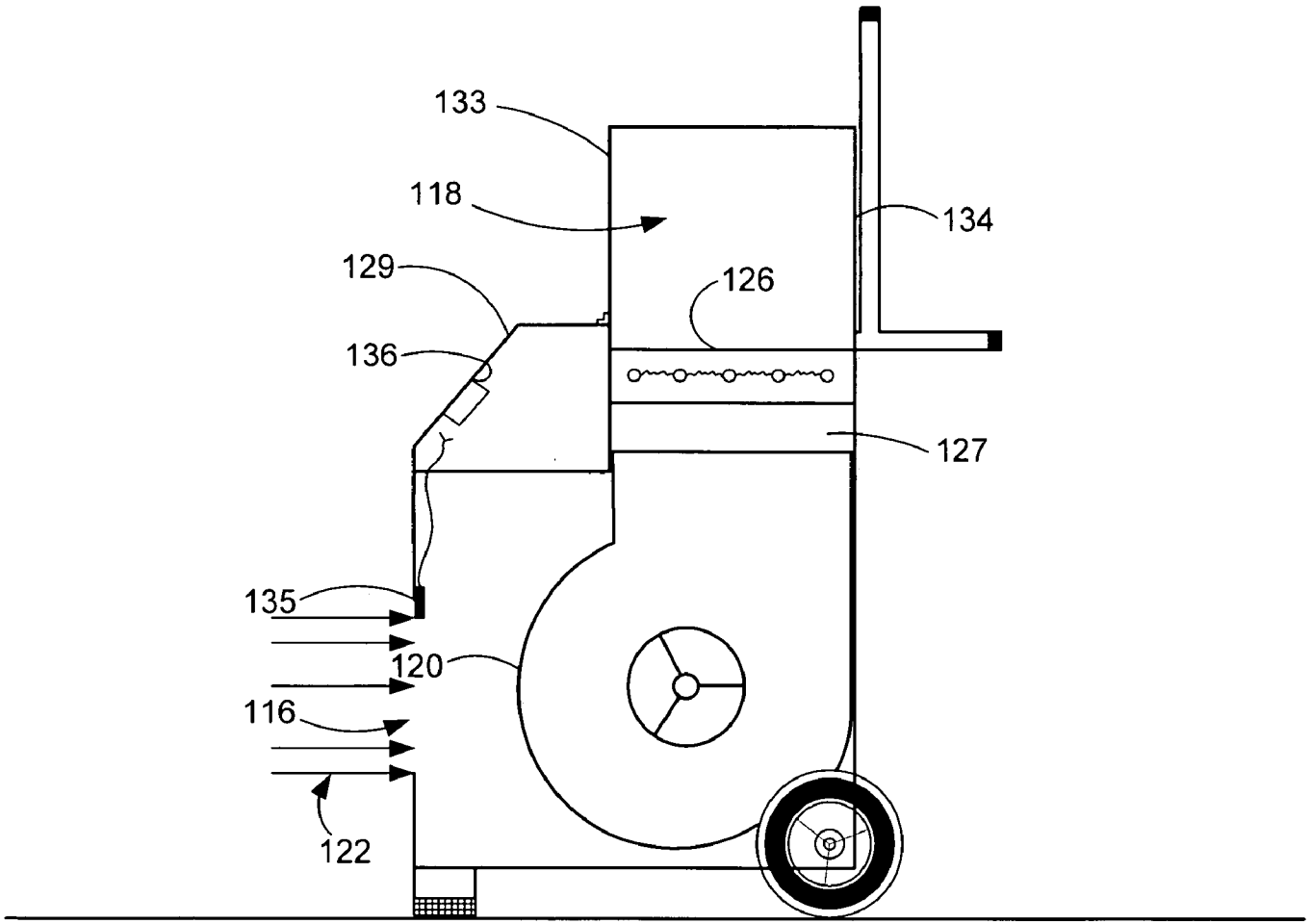
FIG. 3 is a side elevational view of the apparatus of FIG. 1 with the enclosure panel removed to reveal the blower and heater.
Figure 5:
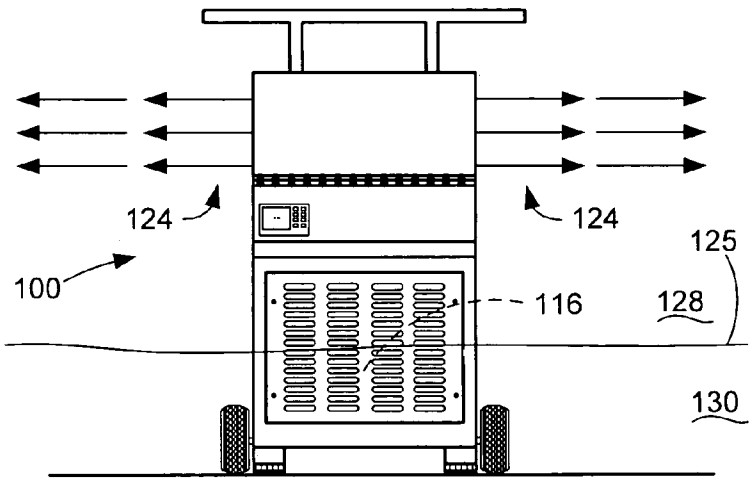
FIGS. 4 and 5 are diagrammatic illustrations of the apparatus of FIG. 1 heating a room space at a particular time and a particular subsequent time, respectively.
Figure 4:
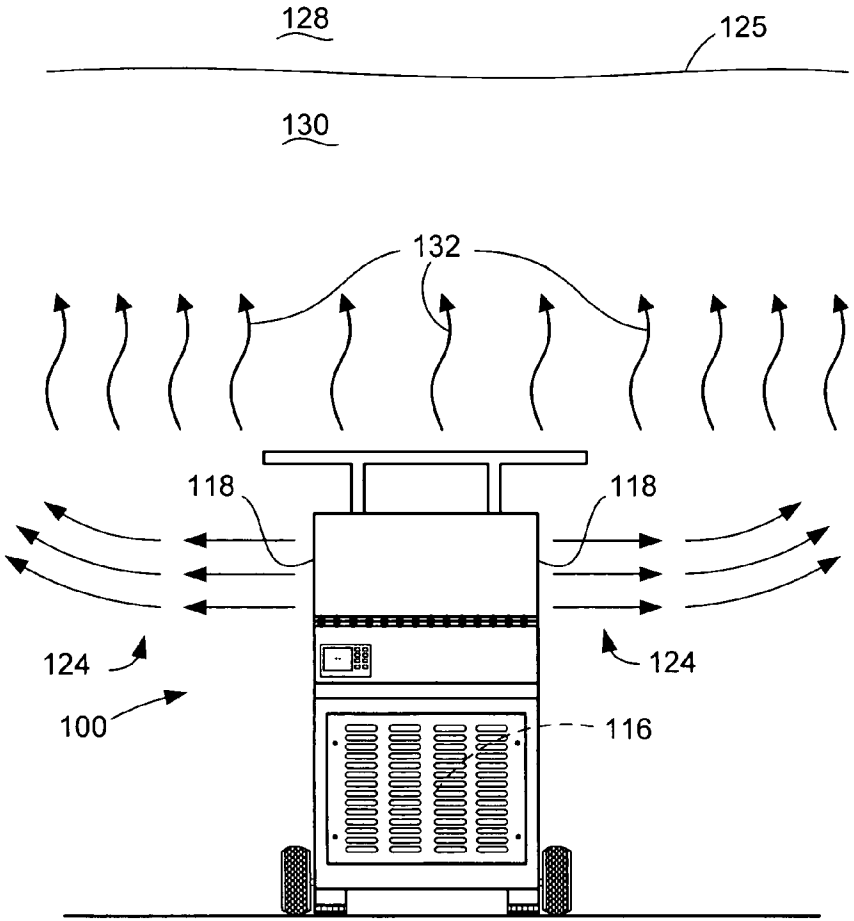

FIG. 3 is a side elevational view similar to FIG. 1 but with a side panel of the disclosure removed for viewing some of the internal construction. The enclosure defines an inlet 116 at a lower end thereof and a plenum with an outlet 118 at an upper end thereof. In FIGS. 1, 2, 4, and 5 the inlet 116 and outlet 118 are shown covered by protective grills. A plurality of front, rear, top, bottom, and side panels cooperate to define a passageway fluidly connecting the inlet 16 and the outlet 118. In further view of FIGS. 4 and 5, a blower 120 imparts an airflow through the passageway, thereby creating an inlet airflow 122 and an outlet airflow 124. Because the outlet 118 is disposed above the inlet 116, the resulting airflows 122, 124 are noncoplanar. Particularly, as discussed below, the embodiments of the present invention make use of the outlet airflow 124 being discharged above the inlet airflow 122 in order to preserve a stratified temperature gradient in the room. A heat generating member 126, such as a bank of electrical resistance strip heating elements, is selectively energized to heat the airflow passing through the passageway. In the illustrative embodiments of FIGS. 3–5, the heat generating member is an airflow-pervious member forming one side of the plenum. An opposing side of the plenum is formed by an airflow-impervious bulkhead. In this arrangement, the airflow directed through the heat generating member dead-heads against the bulkhead, thereby positively pressurizing the plenum in order to redirect the airflow horizontally in at least two different directions with a sufficient velocity to stratify the air in the entire room, as shown in FIGS. 4 and 5. A filter 127 can be installed by sliding it in through a hinged control box 129 compartment.

FIGS. 4 and 5 illustrate embodiments wherein the enclosure defines first and second outlets 118 directing the outlet airflow 124 in two streams of opposing directions. In alternative equivalent embodiments outlets can furthermore or alternatively be formed in a front panel 133 or a rear panel 134. In any event, preferably the outlets 118 are substantially coplanar and disposed substantially orthogonally to the inlet 116 to minimize the mixing of the inlet and outlet airflows 122, 124.

FIG. 4 illustrates the heater package 100 at a time $t_1$ when a stratified temperature gradient 125 exists substantially above the heater package 100. For purposes of this description and the appended claims, the stratified temperature gradient 125 means a dividing boundary between an upper zone 128, wherein the ambient temperature is substantially equivalent to the outlet flow 124 temperature, and a lower zone 130 wherein the ambient temperature is substantially less than the outlet airflow 124 temperature. In this condition it will be noted that the outlet airflow 124 is discharged horizontally and rises gradually due to the density gradient between the warmer outlet airflow 124 and the air in the lower zone 130. Heat from the outlet airflow 124 also rises by convective heat transfer illustrated by the matrix of upwardly tending arrows 132. Note that the horizontally discharged outlet airflow 124 serves to minimize mixing of the air within the stratified zones 128, 130. As heat is added to the air zone 128, it will expand and thereby continually push downwardly on the boundary of the gradient 125, thereby evenly heating the room space. Note also that as the zone 128 increases, the inlet airflow 122 (FIG. 3) continues to be drawn from the relatively cooler air in zone 130.

FIG. 5 is a view similar to FIG. 4 but at a time $t_2$ subsequent to the time $t_1$ when the room space has been heated to the extent that the boundary 125 has dropped to about a vertically middle portion of the airflow inlet 116. A temperature sensor 135 can be positioned in the airflow inlet 116. A control 136, such as an automated thermostat, responsive to the temperature sensor 135 can be used to selectively power the blower 120 and the heat generating member 126. The control 136 has a full compliment of automated features, as is conventional in an automated HVAC control device, for controlling the environment as desired while minimizing operating cost. A setback feature, for example, automatically decreases the lower threshold setpoint a selected amount after the upper threshold setpoint has been satisfied. This permits the environment to reach a comfortable working temperature, and then maintains the environment at a slightly lower temperature typically not noticeable to the workers but resulting in significant reduction in power usage and equipment utilization.

It is not unusual on a construction site for there to only be a temporary power drop available. This can make it problematic for the workers to power both a portable heater and their power equipment. Embodiments of the present invention solve that problem by branching from the inlet power supply 138 a power receptacle 140. Preferably, the inlet power supply 138 supplies 220 volts and the receptacle is stepped down to 120 volts for powering common hand tool equipment.

Figure 6:
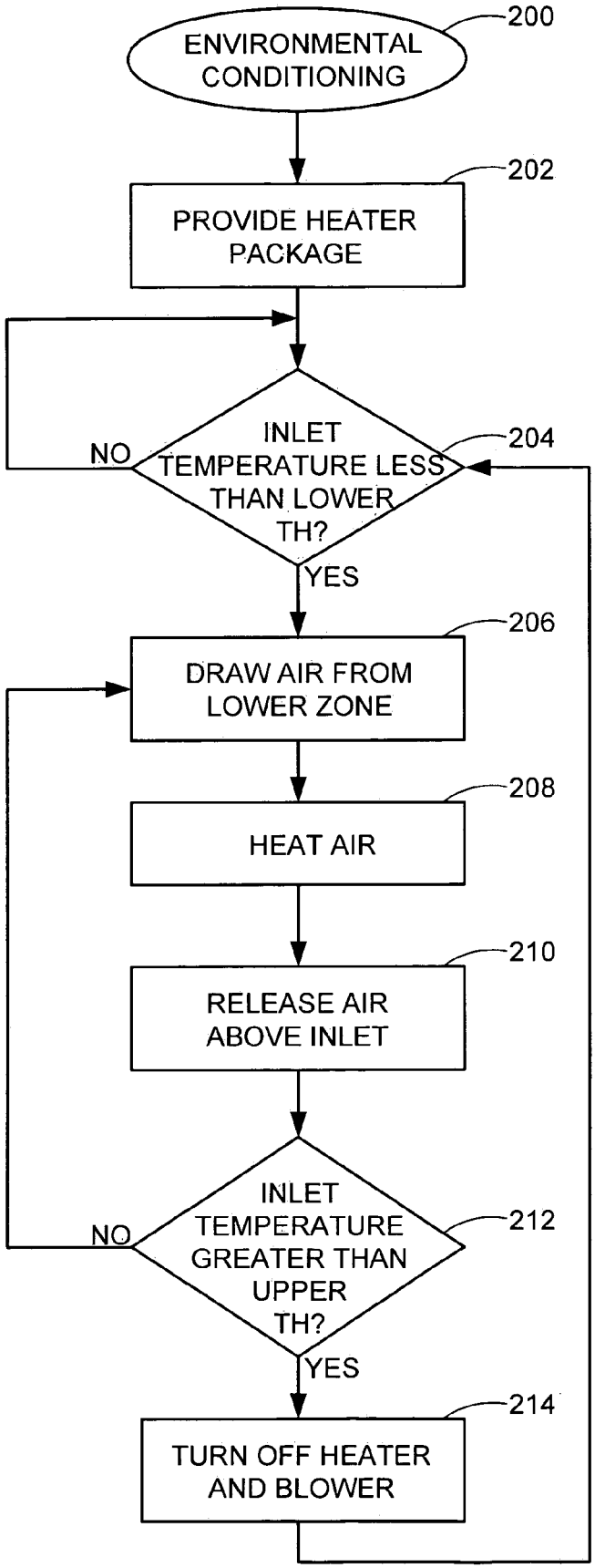
FIG. 6 is a flowchart of steps for performing a method of environmental conditioning in accordance with embodiments of the present invention.

FIG. 6 is a flowchart of steps for a method 200 for environmental conditioning of a room space in accordance with embodiments of the present invention. The method requires a step in block 202 of providing the heater package 100 described above. In block 204 it is ascertained by the control 136 and temperature sensor 135 whether the temperature of inlet airflow 122 at the inlet 116 is less than a preselected lower threshold temperature. This lower threshold temperature can be set in the control 136 as being associated with the minimum desired room temperature. If the determination of block 204 is no, then control remains at block 204; if yes, then control passes to block 206.

In block 206 the blower 120 is energized, and then in block 208 the heat generating device 126 is energized, such that heated air is discharged from the outlet 118 in block 210. In block 212 it is ascertained by the control 136 and temperature sensor 135 whether the temperature of the inlet airflow 122 at the inlet 116 is greater than a preselected upper threshold temperature. This upper threshold temperature can be set in the control 136 as being associated with the maximum desired room temperature. If the determination of block 212 is no, then control returns to block 206 where heating of the air flowing through the passageway continues; if yes, then the heat generating device 126 and the blower 120 are deenergized in block 214 and control returns to block 204. Preferably, a delay circuit will first deenergize the heat generating device 126 and then power to the blower 120 will cut off.

Figure 7:
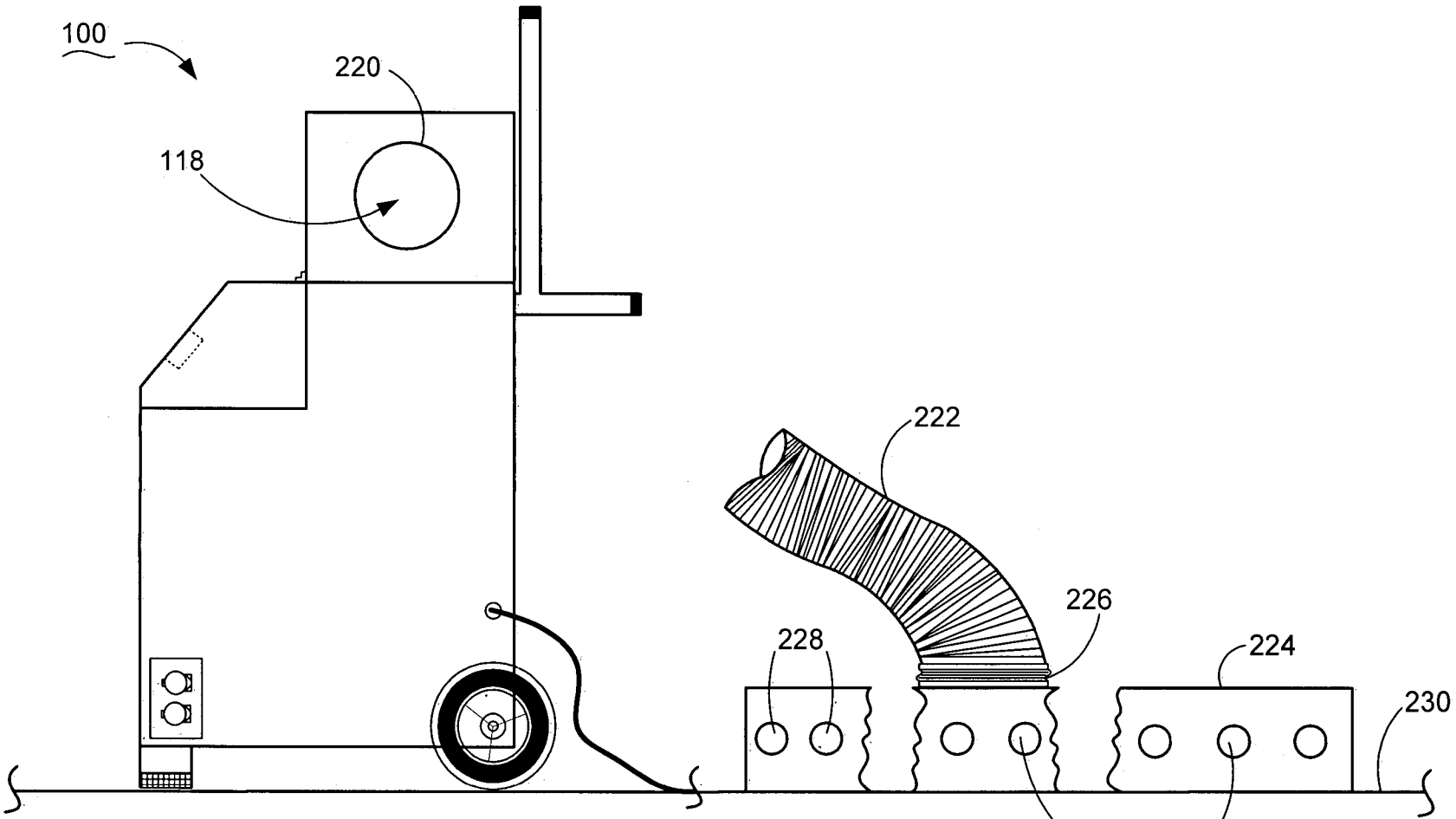

FIG. 7 is a view similar to FIG. 1 but wherein the outlet 118 defines a round flange 220 that is sized for ready attachment of a flexible duct material 222. By attaching the flexible duct material 222 directly to the outlet 118, the outlet airflow 124 can be directed particularly to desired areas. For example, a linear diffuser 224 can be fabricated with a boot 226 for attaching the other end of the flexible duct 222 and thereby directing the outlet airflow 124 out a plurality of diffuser outlets 228. Such an arrangement can be useful, for example, for rapidly warming an area of the floor 230, in preparation for applying construction materials thereto such as adhesive or stain.

Generally, the embodiments of the present invention as described and claimed contemplate a portable room heater (such as 100) comprising an upright enclosure defining an inlet (such as 116) at a lower end of the enclosure, an outlet (such as 118) at an upper end of the enclosure, and a passageway fluidly connecting the inlet and the outlet. The portable room heater has a blower (such as 120) imparting an airflow through the passageway, and thereby creating an inlet airflow (such as 122) through the inlet and a noncoplanar outlet airflow (such as 124) through the outlet. The portable room heater further has a heat generating member (such as 126) in the passageway selectively heating air flowing through the passageway.

A temperature sensor (such as 135) can detect a temperature of the inlet airflow and a control (such as 136) can responsively control the heat generating member in relation to a desired temperature. A removable filter (such as 127) can be used to clean the air circulating through the passageway. Preferably the heater is supported on wheels (such as 102) and equipped with a handle (such as 104), and is sized for transportation through residential doorways in a convenient manner. Preferably, the heater includes a power receptacle (such as 140) adapted for providing an alternating current voltage source for powered equipment.

Preferably, the enclosure defines first and second outlets directed in opposing directions and substantially orthogonal to the inlet. The enclosure can define a third outlet disposed substantially orthogonal and coplanar to the first and second outlets.

A method for environmentally conditioning a room is furthermore provided, requiring the provision of a portable electric heater constructed in accordance with the embodiments of the present invention. The method includes drawing air from a relatively lower horizontal plane of the room into the heater (such as step 206), heating the drawn air (such as step 208), and releasing the heated air in a substantially horizontal direction in a relatively higher horizontal plane of the room (such as step 210).

The method can include providing the heater supported on wheels and with a handle to facilitate transportation. The method can include powering a device from an electrical receptacle of the electric heater. The method can be characterized by setting a desired room temperature in an automatic control of the electric heater. The method can also be characterized by filtering the heated air.

Embodiments of the present invention further contemplate a portable environmental conditioning apparatus comprising a heat source, and means for warming a room by preserving stratified zones of relatively warmer and relatively cooler air, and heating air from the cooler air zone. The means for warming can be characterized by steadily displacing the relatively cooler air zone by increasing the relatively warmer air zone. The means for warming can further be characterized by drawing air from the relatively cooler air zone to the heat source, and releasing air from the heat source in a substantially horizontally disposed direction. The means for warming can further be characterized by powering utility equipment simultaneously while powering the heat source. For purposes of this description and the appended claims, the phrase "means for warming" expressly does not contemplate prior solutions involving coplanar inlet and outlet airflows, and flows that mix the zones of cooler and warmer air thereby defeating the stratification of warmer air for even total room conditioning.

It is to be understood that even though numerous characteristics and advantages of various embodiments of the present invention have been set forth in the foregoing description, together with details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. In addition, although the preferred embodiment described herein is directed to use on a construction site heater, it will be appreciated by those skilled in the art that the teachings of the present invention can be applied to other devices, so as to generally form environmental conditioning devices, for example, without departing from the scope and spirit of the present invention.

What is claimed is:

1. A portable thermal-stratifying space heater apparatus comprising:

an upright enclosure having an outlet at an upper end thereof comprising:

first and second opposing exterior panels;

an airflow-pervious heat generating member supportingly enclosing a bank of substantially parallel electrical resistance strip heating elements, the heat generating member supported at proximal and distal ends thereof by the first and second exterior panels, respectively; and an airflow-impervious panel supported at proximal and distal ends thereof by the first and second panels, respectively; and a blower capable of imparting an airflow flowing from an inlet in a lower end of the enclosure, unidirectionally through the heat generating member, and impinging against the airflow-impervious member to be redirected to flow substantially horizontally through openings in both of the first and second panels.

2. The apparatus of claim 1 wherein the enclosure comprises a pair of wheels supporting opposing sides of one of the first and second exterior panels during wheeled transport.

3. The apparatus of claim 2 wherein the enclosure comprises a handle connected to the one of the first and second exterior panels adapted for transferring a force to pivot the enclosure around the pair of opposing wheels.

4. The apparatus of claim 1 wherein the openings in the first and second panels direct the airflow in opposite directions.

5. The apparatus of claim 4 wherein the openings in the first and second panels are disposed substantially orthogonally to the inlet.

6. The apparatus of claim 1 comprising a temperature sensor detecting a temperature of the inlet airflow and a control responsive to the temperature sensor controlling the heat generating member in relation to a desired temperature.

7. The apparatus of claim 1 comprising a power receptacle adapted for providing an alternating current voltage source for powered equipment.

8. The apparatus of claim 7 wherein the power receptacle provides a nominal 120 volt electrical service.

9. The apparatus of claim 1 comprising a removable filter operably disposed in the airflow.

10. A portable thermal-stratifying space heater apparatus comprising:

a centrifugal blower; and an enclosure comprising an outlet defining a cavity that receives a discharge from the centrifugal blower and directs the discharge from the enclosure horizontally in two different directions, wherein one side of the outlet is comprised of an airflow-pervious heat generating member through which the discharge passes to enter the cavity, and wherein another side of the outlet is comprised of an airflow impervious member disposed downstream of the airflow pervious heat generating member.

11. The apparatus of claim 10 wherein a cross-section of the outlet is characterizable as a straight-sided polygon.

12. The apparatus of claim 11 wherein the cross-section is rectangular.

13. The apparatus of claim 10 wherein another side of the outlet comprises an exterior panel of the enclosure.

14. The apparatus of claim 13 wherein two sides of the outlet comprise exterior panels of the enclose and the heat generating member is connected at each opposing end thereof to one of the exterior panels.

15. The apparatus of claim 13 wherein the heat generating member comprises a bank of electrical resistance strip heating elements.

* * * * *